United States Patent [19]

Lapides

[11] 4,326,918

[45] Apr. 27, 1982

[54] STORAGE ASSEMBLY FOR SPENT NUCLEAR FUEL

[75] Inventor: Melvin E. Lapides, Mountain View, Calif.

[73] Assignee: Electric Power Research Institute, Inc., Palo Alto, Calif.

[21] Appl. No.: 130,134

[22] Filed: Mar. 13, 1980

[51] Int. Cl.[3] ..... G21C 19/20

[52] U.S. Cl. ..... 376/272; 250/506; 252/629

[58] Field of Search ..... 176/30; 250/506, 507; 252/301.1 W

[56] References Cited

U.S. PATENT DOCUMENTS

| | | | |
|---|---|---|---|
| 2,918,717 | 12/1959 | Struxness | 250/506 |
| 3,046,403 | 7/1962 | Montgomery | 250/506 |
| 3,111,586 | 11/1963 | Rogers | 250/507 |
| 3,930,166 | 12/1975 | Bochard | 250/506 |
| 4,021,676 | 5/1977 | Duffy | 250/506 |
| 4,040,480 | 8/1977 | Richards | 250/506 |

*Primary Examiner*—Donald P. Walsh

*Attorney, Agent, or Firm*—Flehr, Hohbach, Test et al.

[57] ABSTRACT

A technique for storing spent fuel rods from a nuclear reactor is disclosed herein. This technique utilizes a housing including a closed inner chamber for containing the fuel rods and a thermally conductive member located partially within the housing chamber and partially outside the housing for transferring heat generated by the fuel rods from the chamber to the ambient surroundings. Particulate material is located within the chamber and surrounds the fuel rods contained therein. This material is selected to serve as a heat transfer media between the contained cells and the heat transferring member and, at the same time, stand ready to fuse into a solid mass around the contained cells if the heat transferring member malfunctions or otherwise fails to transfer the generated heat out of the housing chamber in a predetermined way.

5 Claims, 1 Drawing Figure

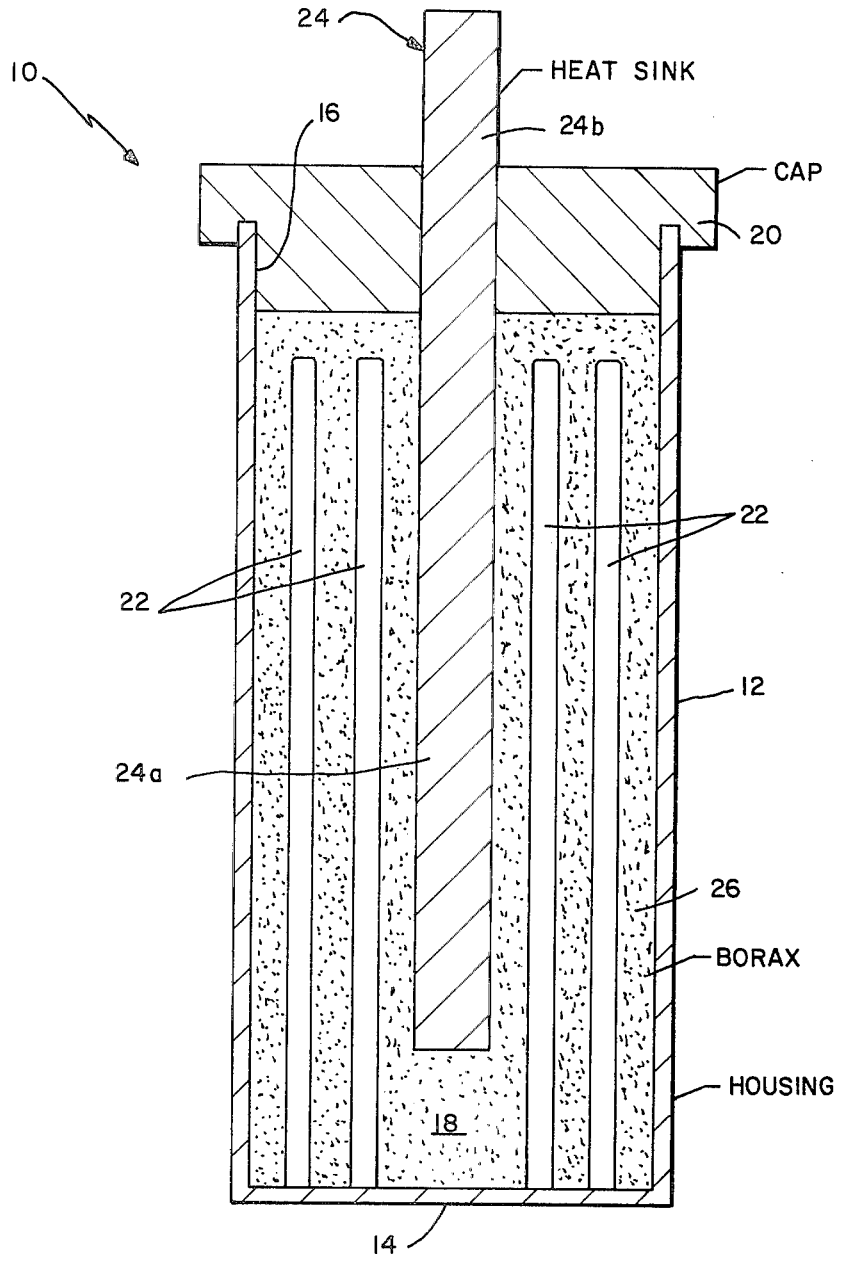
24
10
HEAT SINK
16
24b
CAP
20
22
22
12
24a
26
BORAX
HOUSING
18
14

STORAGE ASSEMBLY FOR SPENT NUCLEAR FUEL

The present invention relates generally to the storage of spent nuclear fuel and more particularly to a low cost, uncomplicated and yet reliable technique for storing spent nuclear fuel safely.

The problem with storing spent (actually partially spent) nuclear fuel is not a new one. Delays in reprocessing have resulted in a particular need for interim storage capability for the spent fuel. Many conventional options exist such as storage pools at or away from reactor sites. However, their implementation is characterized by high cost, long lead times and/or other logistic limitations such as shipping cask availability. As will be seen hereinafter, the present invention eliminates or at least minimizes these constraints by permitting on site or at least localized storage at a relatively low cost using readily available materials.

In view of the foregoing, an object of the present invention is to provide an uncomplicated, economical and yet reliable and safe technique for storing spent fuel from a nuclear reactor.

Another object of the present invention is to provide a nuclear fuel storage technique which utilizes readily available components.

A more specific object of the present invention is to provide an assembly for storing spent fuel, which assembly has a predesigned cooling capability while, at the same time, automatically compensating for a malfunction in this capability.

Another more specific object of the present invention is to provide a fuel storage assembly which utilizes the same means for protecting the assembly against cooling malfunction while, at the same time, serving as a heat transfer media, a neutronic poison and as an absorber/-combining agent for any non-gaseous material inadvertently released from the contained fuel rods.

As will be described in more detail hereinafter, the storage assembly disclosed herein is one which has housing means adapted for positioning underground and including a closed inner chamber for containing the nuclear fuel, e.g., the fuel rods. A thermally conductive member is located partially within the inner chamber and partially outside the housing means for transferring heat generated by the contained nuclear fuel from the housing chamber to the surrounding ground. In accordance with the present invention, particulate material is located within the chamber and around the nuclear fuel contained therein. This material is seclected so as to serve as a heat transfer media between the contained nuclear fuel and the heat transferring member while, at the same time, standing ready to fuse into a solid mass around the contained nuclear fuel if the heat transferring rod malfunctions or otherwise fails to transfer the heat generated by the fuel out of the chamber in a predetermined manner.

In a preferred embodiment, the particulate material is borax. This preferred embodiment will be described in more detail below in conjunction with the attached, sole FIGURE which is a vertical sectional view of the assembly designed in accordance with the present invention.

Referring to the FIGURE, the overall storage assembly which is adapted for positioning underground is generally indicated by the reference numeral 10. This assembly is shown including an elongated housing 12 having a closed bottom end 14, an opened top end 16 and an inner chamber 18. A cap 20 cooperates with opened top end 16 for closing the chamber. In a preferred embodiment, housing 12 is formed from a steel pipe and cap 20 is constructed of steel. However, it is to be understood that housing 12 could also be constructed of concrete or other metals or composites and end cap 20 could be constructed of other suitable materials such as concrete. In addition, while closed end 14 is shown as an integral part of the housing, a pipe, tube or other such hollow, elongated member opened at both ends could be initially provided as the housing and closed at each end by a pair of caps 20. The exact size of housing 12 may vary depending upon the size, shape and amount of nuclear fuel to be contained within chamber 18. In the embodiment illustrated, the nuclear fuel contained within the chamber is in the form of fuel rods generally indicated at 22. As shown, these fuel rods stand upright within the housing and are spaced from one another. In a contemplated working embodiment, as many as 1000 rods will be stored within a given assembly. The housing necessary to store the rods should be at least about 12 feet in length and 18 inches in diameter (assuming a circular cross-section).

Storage assembly 10 also includes a thermally conductive rod, pipe or similar elongated member 24 which extends through a cooperating opening in cap 20 so as to include one end section **24*a* within housing chamber 18 and an opposite end section 24*b* outside housing 12. This member serves to transfer heat generated by the fuel rods 22 contained within chamber 18 from the latter to the surrounding environment. In this regard, the heat transferring member is preferrably oriented in a direction parallel with the fuel rods centrally within housing 18 as shown, although this is not absolutely necessary. Moreover, while member 24** is preferrably constructed of a cored tube, containing a liquid and a capillary wick known in the art as a heat pipe. It may be constructed of other thermally conductive materials such as copper or aluminum or like material compatible with the environment within the inner chamber and the surrounding environment. Moreover, while only one heat transferring member is shown, more than one could be utilized.

In accordance with the present invention, particulate material is provided within housing chamber 18 and surrounds the fuel rods 22 contained therein. This material is of a type selected to serve as a heat transfer media between the contained fuel cells and heat transferring member (or members) and also must be capable of fusing into a solid mass around the contained members if the latter malfunction or otherwise fail to transfer heat generated from the nuclear fuel out of the chamber causing extensive heat to build up in the latter. In a preferred embodiment, the particulate material selected is granulated borax. This material not only serves as a heat transfer and fusing media, but also as a neutronic poison and as an absorber/combining agent for any non-gaseous material inadvertently released from the fuel rods. In a contemplated actual embodiment, the granulated borax 26 contained within the chamber 18 has a density of between about 1.4 and 1.7 grams/cm$^3$, although the present invention is not limited to this particular physical characteristic. The particle size may also vary. In the contemplated embodiment, the particles range in size between about 60 and 200 mesh. Other contemplated particulate materials to be used in lieu of or in combination with the borax are lesser hydrates of borate.

The overall storage assembly described offers a basic, low cost technique of interim fuel storage both with respect to initial cost and low operating cost. The total assembly can be placed in the ground at a reactor site. The passive heat transfer mechanism, e.g., the combination of particulate material 26 and member (or members) 24, reduces or eliminates maintenance requirements. In the unlikely event of a loss of cooling capability by member 24, the particulate material will fuse to a glasseous structure confining the fuel rods. In this regard, the borax itself has a softening point of 167° F. and, hence, when the heat within chamber 18 builds up to this level, the borax particles begin to soften. As the heat remains and continues to build up above this level the borax particles begin to fuse into its glasseous structure. Obviously, the temperature at which fusion begins to take place will vary depending upon the particulate material selected. It should however be above 400° F. which is an acceptable (maximum) operating temperature within chamber 13 assuming the overall assembly operates normally.

The overall storage assembly described is contemplated for use in storing LWR spent fuel elements, although it is not limited to these particular elements or reactors.

What is claimed is:

1. An assembly for storing spent fuel rods from a nuclear reactor, said assembly comprising:

(a) housing means including a closed inner chamber for containing said fuel rods, said housing means being adapted for positioning underground;

(b) means located partially within said inner chamber and partially outside said housing means for transferring heat generated by the fuel rods contained within said housing chamber from the latter to said surrounding ground; and (c) particulate material located within said chamber and surrounding the fuel rods contained therein, said material being of a type which serves as a heat transfer media between said contained fuel rods and said heat transferring means and which also fuses into a solid mass around said contained rods if said heat transferring means malfunctions or otherwise fails to transfer said generated heat out of said chamber in a predetermined manner.

2. An assembly according to claim 1 wherein said particulate material is also of a type to serve as a neutronic poison for any non-gaseous substance which might be inadvertently released from said contained fuel rods.

3. An assembly according to claim 2 wherein said particulate material is borax.

4. An assembly according to claim 1 wherein said heat transferring means includes a thermally conductive, elongated member having one end section located within said chamber and an opposite end section positioned outside said housing means.

5. An assembly for storing spent fuel rods from a nuclear reactor, said assembly comprising:

(a) an elongated housing closed at one end, open at the opposite end and defining an inner chamber for containing said fuel rods, said housing including an end cap for closing its open end and inner chamber, said closed housing being adapted for positioning underground;

(b) a thermally conductive, elongated member extending through said housing cap so as to include one end section with said housing chamber and an opposite end section outside said housing for transferring heat generated by the fuel rods contained within said housing from the inner chamber of the latter to the surrounding ground; and (c) particulate borax located within said housing chamber and surrounding the fuel rods contained therein, said borax serving as a heat transfer media between said contained fuel rods and said heat transferring members and also serving to fuse into a solid mass around the contained fuel cells in the event that the heat transferring member malfunctions or otherwise fails to transfer said generated heat out of said chamber in a predetermined manner.

* * * * *